US009937533B2

(12) United States Patent
Ji et al.

(10) Patent No.: US 9,937,533 B2
(45) Date of Patent: Apr. 10, 2018

(54) PANEL POLISHING DEVICE AND PANEL CLEANING EQUIPMENT

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Laichao Ji, Beijing (CN); Jinjun Wang, Beijing (CN); Zhendong Wang, Beijing (CN); Rui Hu, Beijing (CN); Jingxin Mao, Beijing (CN); Tongtong Huang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 186 days.

(21) Appl. No.: 15/168,840

(22) Filed: May 31, 2016

(65) Prior Publication Data

US 2017/0043382 A1 Feb. 16, 2017

(30) Foreign Application Priority Data

Aug. 12, 2015 (CN) ..... 2015 1 0493703

(51) Int. Cl.
*B08B 7/04* (2006.01)
*B08B 11/00* (2006.01)
(Continued)

(52) U.S. Cl.
CPC ..... *B08B 1/008* (2013.01); *B05B 1/14* (2013.01); *B05B 1/20* (2013.01); *B05B 7/2489* (2013.01); *B08B 1/02* (2013.01); *B08B 11/04* (2013.01)

(58) Field of Classification Search
CPC ..... B05B 1/14; B05B 1/20; B05B 7/2489; B08B 11/04; B08B 1/008; B08B 1/02
See application file for complete search history.

(56) References Cited

U.S. PATENT DOCUMENTS

2007/0261717 A1* 11/2007 Yoshida ..... B08B 1/04 134/33
2013/0081655 A1* 4/2013 Mendiratta ..... B08B 1/02 134/15

FOREIGN PATENT DOCUMENTS

JP 2005081297 A * 3/2005
JP 3727162 B2 * 12/2005
(Continued)

*Primary Examiner* — Marc Carlson
(74) *Attorney, Agent, or Firm* — Nath, Goldberg & Meyer; Joshua B. Goldberg; Stanley N. Protigal

(57) ABSTRACT

Disclosed is a panel polishing device, comprising a polishing belt movable along a predefined direction and a spray head arranged above the belt. The spray head has a main body and a plurality of through-holes penetrating the main body in its thickness direction. Through-holes have outlets facing the belt and are arranged along a length direction of the spray head. The length direction of the spray head conforms to a movement direction of the belt. At least the through-holes on both sides of the main body are oblique outwardly with respect to the remaining through-holes. Also, the disclosure provides a panel cleaning equipment including the panel polishing device. In the device according to the disclosure, pressure of bi-component fluid is more widely applied onto belt and a larger belt is contacted with the panel, such that the panel is thoroughly cleaned without polishing blind regions on both sides thereof.

20 Claims, 4 Drawing Sheets

(51) Int. Cl.

| | |
|---|---|
| ***B08B 3/10*** | (2006.01) |
| ***B08B 1/04*** | (2006.01) |
| ***B08B 1/02*** | (2006.01) |
| ***B08B 3/02*** | (2006.01) |
| ***B08B 1/00*** | (2006.01) |
| ***B05B 1/14*** | (2006.01) |
| ***B08B 11/04*** | (2006.01) |
| ***B05B 1/20*** | (2006.01) |
| ***B05B 7/24*** | (2006.01) |

(56) References Cited

FOREIGN PATENT DOCUMENTS

| | | | | |
|---|---|---|---|---|
| JP | 2007059438 | A | * | 3/2007 |
| KR | 20080024793 | A | * | 3/2008 |
| KR | 20120118984 | A | * | 10/2012 |
| KR | 101382472 | B1 | * | 4/2014 |

* cited by examiner

PANEL POLISHING DEVICE AND PANEL CLEANING EQUIPMENT

CROSS-REFERENCE TO RELATED APPLICATION

This application claims the priority of Chinese Patent Application No. 201510493703.7 filed on Aug. 12, 2015, titled "panel polishing device and panel cleaning equipment" in the Chinese Intellectual Property Office, the disclosure of which is incorporated herein by reference.

FIELD OF THE INVENTION

The disclosure relates to the field of cleaning panel, and in particular to a panel polishing device and a panel cleaning equipment including the panel polishing device.

BACKGROUND OF THE INVENTION

After a display panel is manufactured, surfaces of the display panel are necessarily subjected to surface polishing. In the prior art, the surface polishing process may include: spraying bi-component fluid (i.e., water and gas) to a polishing belt through a spray head such that the bi-component fluid can wet the polishing belt, and then pressing the wetted polishing belt against a panel to be polished. By polishing, foreign matters on the surfaces of the panel can be removed.

FIG. 1 is a front cross-section view of a spray head in the prior art, and FIG. 2 is a top plan view of the spray head as shown in FIG. 1. As shown in FIG. 1 and FIG. 2, the spray head 100 may include a main body 110 and through-holes 120 penetrating the main body. The bi-component fluid can be sprayed from the through-holes 120 onto the polishing belt. The sprayed bi-component fluid can wet the polishing belt and press the polishing belt against the panel to be polished. FIG. 3 is a schematic diagram in which the polishing belt 200 is used to polish a panel 300, wherein a longitudinal arrow represents a movement direction of the panel 300 and a transversal arrow represents a movement direction of the polishing belt 200. FIG. 4 is a schematic diagram of a spraying direction of the bi-component fluid when the spray head in the prior art is used to clean the panel. As shown in FIG. 4, a range of the bi-component fluid which is sprayed onto the polishing belt 200 is defined by a projection region A of the through-holes 120 on the polishing belt 200. Therefore, in FIG. 3, polishing blind regions (Region I and Region II) may occur on both sides of the panel 300, resulting in an incompletely cleaned panel.

Therefore, how to completely clean the panel has become a technology problem to be solved in this art.

SUMMARY OF THE INVENTION

An objective of the disclosure is to provide a panel polishing device and a panel cleaning equipment including the panel polishing device, so as to completely clean the panel.

In order to achieve above objectives, as one aspect of the disclosure, there is provided a panel polishing device, comprising: a polishing belt movable along a predefined direction; and a spray head arranged above the polishing belt, the spray head having a main body and a plurality of through-holes which penetrate the main body in a thickness direction of the main body, the plurality of through-holes having outlets facing the polishing belt and being arranged along a length direction of the spray head, and the length direction of the spray head being in conformity with a movement direction of the polishing belt, wherein at least the through-holes on both sides of the main body are oblique outwardly with respect to the remaining through-holes.

Preferably, the spray head comprises a plurality of rows of through-holes arranged side by side in a width direction of the main body.

Preferably, among the through-holes in at least one row arranged in the length direction of the main body, the through-holes in the middle in the length direction of the main body have vertical axes.

Preferably, the through-holes of the main body in a row on a downstream side in a movement direction of the panel have outwardly oblique axes.

Preferably, with reference to a central line in the length direction of the main body, the axes of the through-holes on a left side are oblique towards the left side of the main body, while the axes of the through-holes on a right side are oblique towards the right side of the main body.

Preferably, the panel polishing device further comprises a liquid-gas mixture chamber disposed over the spray head, and the through-holes are communicated with the liquid-gas mixture chamber.

Preferably, the panel polishing device comprises a mounting rack and a plurality of driving wheels fixedly attached to the mounting rack; the polishing belt is wound around the plurality of driving wheels and moves in the predefined direction under the action of the driving wheels; and the spray head is positioned within a region defined by the polishing belt and over a portion of the polishing belt.

Preferably, the plurality of driving wheels comprise a driving pulley, a driven pulley and two tension pulleys; the driving pulley and the driven pulley are position on the same side, and the two tension pulleys are position on the opposite side, such that the polishing belt wound around the plurality of driving wheels is formed into a quadrilateral; and the spray head is fixed to a portion of the polishing belt between the two tension pulleys.

Preferably, the panel polishing device further comprises a sensor for detecting the presence of the panel, an electrical motor for rotating the driving pulley and a controller; the sensor is arranged on the mounting rack and adjacent to the panel; when the sensor detects the presence of the panel, the sensor is able to generate a sensing signal and send the sensing signal to the controller; and the controller generates a control signal for controlling the rotation of the electrical motor upon the receipt of the sensing signal.

Preferably, the panel polishing device further comprises a liquid inlet pipe for introducing liquid, a first switch valve mounted on the liquid inlet pipe, a gas inlet pipe and a second switch valve mounted cm the gas inlet pipe.

Preferably, both the first switch valve and the second switch valve are solenoid valves; a control terminal of the first switch valve is connected to the controller, and a control terminal of the second switch valve is connected to the controller; upon the receipt of the sensing signal, the controller sends a first open signal to the control terminal of the first switch valve so as to open the first switch valve; and upon the receipt of the sensing signal, the controller sends a second open signal to the control terminal of the second switch valve so as to open the second switch valve.

As another aspect of the disclosure, there is provided a panel cleaning equipment, comprising a panel polishing device, a gas source and a liquid source, wherein the panel polishing device is the panel polishing device according to the disclosure; and the gas supplied from the gas source and the liquid supplied from the liquid source are mixed, then enter the through-holes, and are sprayed onto the polishing belt through the through-holes.

Preferably, the panel cleaning equipment comprises a panel transport unit which is configured to pass the panel through the polishing belt of the panel polishing device and a transport direction of which is perpendicular to the movement direction of the polishing belt.

Preferably, the panel transport unit comprises a front conveying rail and a rear conveying rail, and the panel polishing device is arranged between the front conveying rail and the rear conveying rail.

Preferably, the panel cleaning equipment comprises two panel polishing devices; and the polishing belts of the two panel polishing devices are disposed oppositely so as to polish both surfaces of the panel at the same time.

In the panel polishing device according to the disclosure, the pressure of bi-component fluid can be more widely applied onto belt and a larger belt can be contacted with the panel to be polished, such that the panel can be thoroughly cleaned without polishing blind regions on both sides thereof.

BRIEF DESCRIPTION OF THE DRAWINGS

Accompanying drawings are provided for further understanding of this disclosure and constituting a part of the specification. Hereinafter, these drawings are intended to explain the disclosure together with the following specific embodiments, but should not be considered as a limitation of the disclosure. In which.

REFERENCE NUMERAL LIST

100: spray head; 110: main body; 120: through-hole; 200: polishing belt; 300: panel, 400: mounting rack; 510: driving pulley; 520: driven pulley; 530, 540: tension pulley; 600: sensor; 610: conveying roller; 700: liquid inlet pipe; 800: gas inlet pipe; and 900: second switch valve

DETAILED DESCRIPTION OF THE EMBODIMENTS

Hereinafter, specific embodiments of the disclosure will be described in detail in conjunction with the accompanying drawings. It should be understood that the specific embodiments as set forth herein are merely for the purpose of illustration and explanation of the disclosure and should not be constructed as a limitation thereof.

Figure 5:
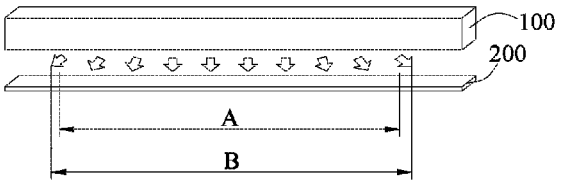
FIG. 5 is a schematic diagram of a spraying direction of bi-component fluid when the spray head according to the disclosure is used to clean the panel.
Figure 6:
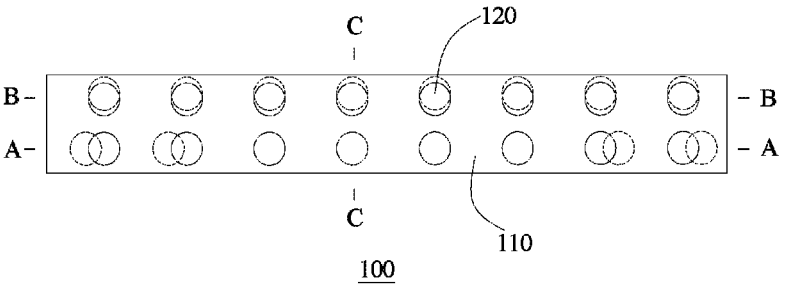
FIG. 6 is a top plan view of the spray head according to an embodiment of the disclosure.
Figure 7:
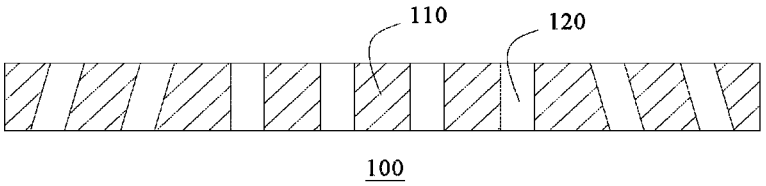
FIG. 7 is a cross-section view taken along a line A-A in FIG. 6.

As one aspect of the disclosure, there is provided a panel polishing device. As shown in FIG. 5, the polishing device may include: a polishing belt 200 movable along a predefined direction; and a spray head 100 arranged above the polishing belt 200. As shown in FIG. 6 and FIG. 7, the spray head 100 may include a main body 110 and a plurality of through-holes 120 which penetrate the main body 110 in a thickness direction of the main body 110. The plurality of through-holes 120 may have outlets facing the polishing belt 200 and be arranged along a length direction of the spray head 100. The length direction of the spray head 100 is in conformity with a movement direction of the polishing belt 200. Furthermore, at least the through-holes 120 on both sides of the main body 110 are oblique outwardly with respect to the remaining through-holes 120.

Figure 1:
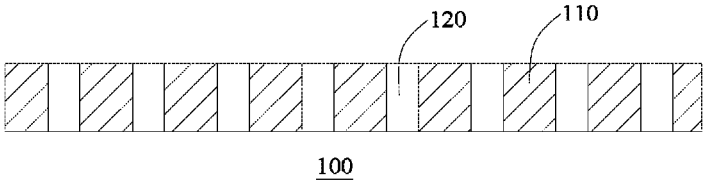
FIG. 1 is a front cross-section view of a spray head in the prior art.
Figure 2:
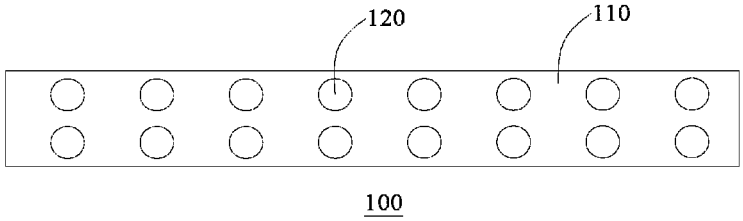
FIG. 2 is a top plan view of the spray head in the prior art.
Figure 3:
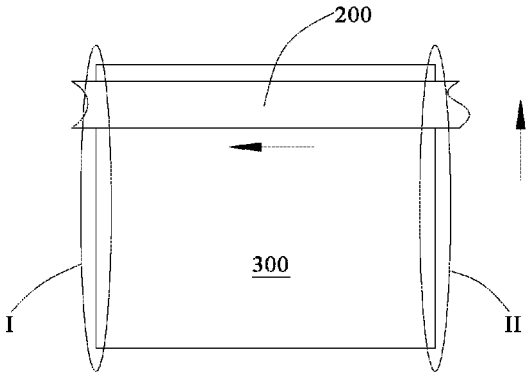
FIG. 3 is a schematic diagram of blind areas generated when the spray head in the prior art is used to clean the panel.
Figure 4:
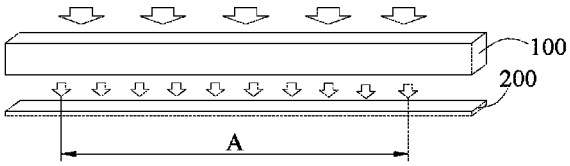
FIG. 4 is a schematic diagram of a spraying direction of bi-component fluid when the spray head in the prior art is used to clean the panel.

FIG. 7 only shows the through-holes 120 on both sides of the spray head and a portion of the remaining through-holes 120 rather than all the through-holes 120 on the spray head. Since the through-holes 120 on both sides of the spray head 100 are oblique outwardly with respect to the remaining through-holes 120, as shown in FIG. 5, when the spray head 100 sprays the bi-component fluid towards the polishing belt 200, the through-holes 120 on both sides of the spray head 100 can spray the bi-component fluid obliquely downwards. In such a manner, a region of the polishing belt 200 where the bi-component fluid is received (the region indicated by an Arrow B in FIG. 5) exceeds the projection region corresponding to the through-holes of the spray head 100 arranged in the length direction (the region indicated by an Arrow A in FIG. 5). However, in the prior art in FIG. 4, the range of the bi-component fluid which is sprayed onto the polishing belt 200 is defined by the projection region of the through-holes 120 on the polishing belt 200 (the region indicated by an Arrow A in FIG. 4). Therefore, when the spray head 100 in the prior art is used to spray the bi-component fluid towards the polishing belt 200, the bi-component fluid is sprayed only onto the projection region of the through-holes arranged in the length direction on the polishing belt 200 (the region indicated by an Arrow A in FIG. 4). By comparison, in the panel polishing device according to the disclosure, the pressure of the bi-component fluid may be more widely applied onto polishing belt 200. Therefore, a larger polishing belt 200 can be brought into contact with the panel to be polished, such that the panel can be thoroughly cleaned without polishing blind regions on both sides of the panel (Region I and Region II in FIG. 3).

In the disclosure, the pressure of the bi-component fluid sprayed from the spray head will no longer concentrate on a middle portion of the polishing belt, thereby reducing abrasion of the middle portion of the polishing belt.

In order to guarantee a larger area on the polishing belt 200 for receiving the pressure of the bi-component fluid, preferably, as shown in FIG. 6, the spray head 100 may include a plurality of rows of through-holes 120 (for example, as shown in FIG. 6, two rows in the embodiment) arranged side by side in a width direction of the main body 110.

It should be understood by those skilled in the art, the polishing belt 200 herein is made of materials which can be moistened by liquid. Further, the polishing belt 200 is required to be supple, so that the panel to be polished cannot be scratched. For example, the polishing belt 200 can be made of woolen material.

Figure 11:
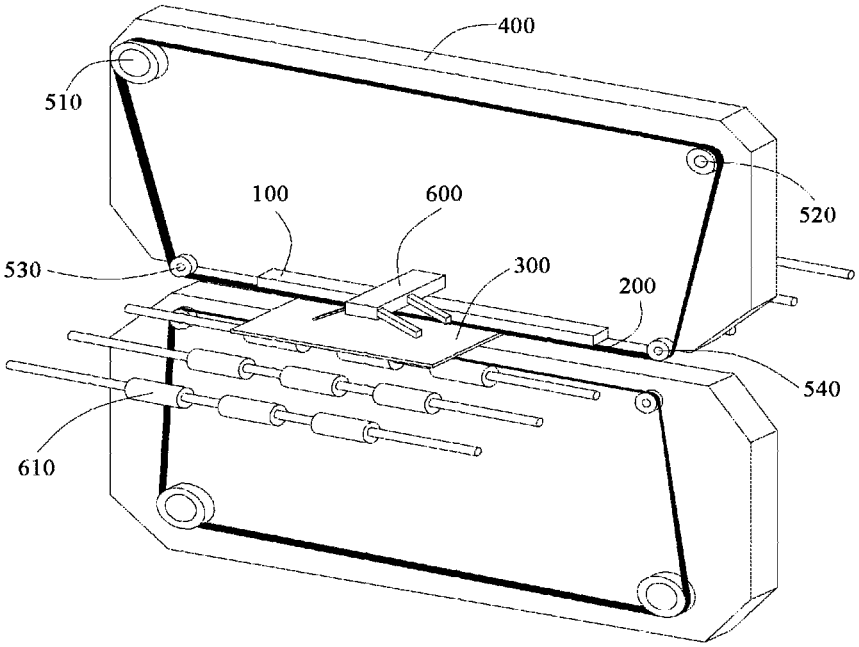
FIG. 11 is a perspective view schematically illustrating a structure of a panel polishing device having the spray head according to the disclosure.

In this embodiment of the disclosure, the width direction of the spray head 100 is in conformity with the movement direction of the panel to be polished (cf. FIG. 11). Since a plurality of rows of the through-holes are arranged on the spray head 100, portions of the polishing belt 200 underneath the spray head 100 can receive the pressure of the bi-component fluid so as to more tightly contact with the panel to be polished.

In order to ensure that the portions of the polishing belt 200 underneath the spray head 100 can receive a sufficient pressure, preferably, among the through-holes in at least one row arranged in the length direction of the main body 110, the through-holes in the middle in the length direction of the main body 110 have vertical axes. FIG. 7 is a cross-section view of the spray head taken along line A-A in FIG. 6. As could be seen from FIG. 7, among the through-holes of the spray head 100 in the first row as shown in FIG. 6, the through-holes in the middle of the main body 110 in the length direction have vertical axes. Therefore, the bi-component fluid can be sprayed vertically from the through-holes in the middle of the main body 100 without horizontal component of force. Therefore, a portion of polishing belt underneath the middle through-holes can receive a greater downward pressure, such that the polishing belt can more tightly contact with the panel.

Figure 8:
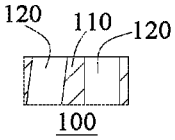
FIG. 8 is a cross-section view taken along a line C-C in FIG. 6.

Preferably, in order to further enlarge the region of the polishing belt 200 receiving the bi-component fluid, as shown in FIG. 6 and FIG. 8, the through-holes of the main body 110 in a row on a downstream side in a movement direction of the panel may have outwardly oblique axes.

It should be readily understood that, herein, the panel is moved from upstream to downstream such that an upstream side of the polishing belt is brought into contact with the panel firstly and then a downstream side thereof is brought into contact with the panel. Accordingly, a side of the spray head corresponding to the upstream side of the polishing belt is defined as an upstream side of the spray head, and a side of the spray head corresponding to the downstream side of the polishing belt is defined as a downstream side of the spray head.

Figure 9:
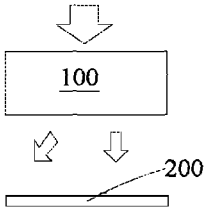
FIG. 9 is a side view schematically illustrating the bi-component fluid sprayed from the spray head according to the embodiment of the disclosure.

In FIG. 6, a lower side of the spray head 100 is defined as an upstream side, and an upper side of the spray head 100 is defined as a downstream side. Therefore, the axes of through-holes 120 on the downstream side are oblique towards the downstream direction. Since lower ends of the through-holes 120 on the downstream side are oblique towards the downstream, as shown by arrows in FIG. 9, the downstream side of the polishing belt 200 (left side in FIG. 9) may provide an increased area for receiving the bi-component fluid. During the movement of the panel, the downstream side of the polishing belt 200 may also be tightly contact with the panel to be polished, such that the panel can be more thoroughly cleaned and the cleaning blind region can be further reduced. Also, one of advantages that the through-holes on the downstream side are arranged to be the oblique through-holes may be in that it is possible to prevent the middle portion of the polishing belt 200 from being excessively worn so as to increase service time of the polishing belt.

Figure 10:
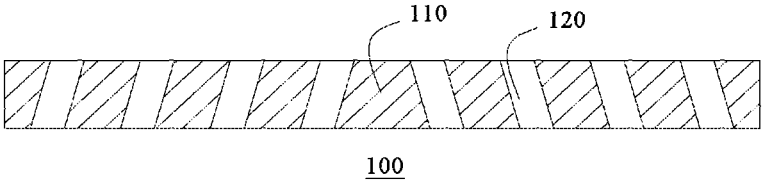
FIG. 10 is a cross-section view of a spray head according to another embodiment of the disclosure.

FIG. 10 is a cross-section view of a spray head 100 according to another embodiment of the disclosure. As shown in FIG. 10, with reference to a central line in the length direction of the main body 110 (a left-right direction in FIG. 10), the axes of the through-holes 120 on left side are oblique towards the left side of the main body 110, while the axes of the through-holes 120 on right side are oblique towards the right side of the main body 110.

FIG. 10 is the cross-section view illustrating one of rows of the through-holes 120 in the spray head 100. It should be understood that the spray head 100 may include a plurality of rows of through-holes 120 which are oblique in the same manner. When the spray head in FIG. 10 is used to spray the bi-component fluid to the polishing belt, the area of the bi-component fluid on the polishing belt can be enlarged to further increase a pressurized area of the polishing belt. Therefore, it is possible to enlarge the cleaning region of the polishing belt while reducing or even eliminating the cleaning blind region.

In the bi-component fluid, liquid is mainly used to wet the polishing belt, while gas is mainly used to supply pressure to the polishing belt. The mixture of liquid and gas can provide both wetting and impact.

Figure 12:
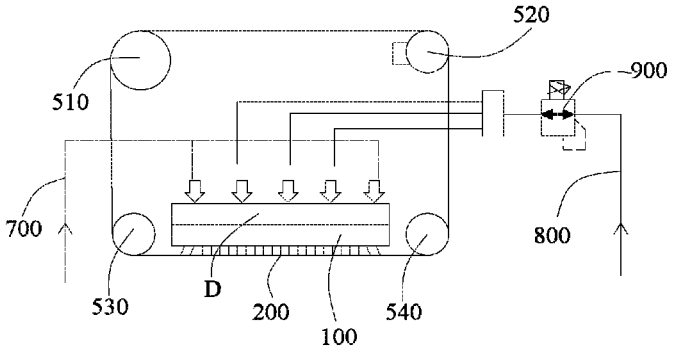
FIG. 12 is a diagram schematically illustrating a working principle of the panel polishing device having the spray head according to the disclosure.

FIG. 11 is a perspective view schematically illustrating a structure of a panel polishing device having the spray head according to the disclosure; and FIG. 12 is a diagram schematically illustrating a working principle of the panel polishing device having the spray head according to the disclosure.

As shown in FIG. 11 and FIG. 12, the panel polishing device may further include a liquid-gas mixture chamber (i.e., fluid mixture chamber) D disposed over the spray head 100, and the through-holes 120 of the spray head 100 are communicated with the liquid-gas mixture chamber D. The pressurized gas and the liquid are uniformly mixed in the liquid-gas mixture chamber D and sprayed to the polishing belt 200 from the through-hole.

As shown in FIG. 12, the panel polishing device may further include a liquid inlet pipe 700 and a gas inlet pipe 800. The liquid inlet pipe 700 and the gas inlet pipe 800 are both communicated with the liquid-gas mixture chamber D so as to introduce liquid and gas into the liquid-gas mixture chamber D, respectively.

In the disclosure, the polishing belt 200 is also movable, so as to bring foreign matters on the panel to the outside of the panel. In the disclosure, movement manners of the polishing belt 200 are not restricted. For example, preferably, in order to facilitate operations and economize on labor, as shown in FIG. 11, the panel polishing device may include a mounting rack 400 and a plurality of driving wheels fixedly attached to the mounting rack 400. The polishing belt 200 may be wound around the plurality of driving wheels and move in the predefined direction under the action of the driving wheels. The spray head 100 is positioned within a region defined by the polishing belt 200 and over a portion of the polishing belt 200.

When the driving wheels are rotated, it is possible to drive the polishing belt 200 to move. Since the spray head 100 is positioned within the region defined by the polishing belt 200 and over a portion of the polishing belt 200, the spray head 100 may spray the bi-component fluid to the non-polishing surface of the polishing belt 200.

As a specific embodiment of the disclosure, as shown in FIG. 11, the plurality of driving wheels may include a driving pulley 510, a driven pulley 520 and two tension pulleys 530 and 540. The driving pulley 510 and the driven pulley 520 are position on the same side, and the two tension pulleys 530 and 540 are position on the opposite side, such that the polishing belt 200 wound around the plurality of driving wheels is formed into a quadrilateral. The spray head 100 is fixed to a portion of the polishing belt 200 between the two tension pulleys 530 and 540.

When the driving pulley 510 is rotated under the action of an electrical motor, the polishing belt 200 can be driven to move.

In order to facilitate auto-control, preferably, the panel polishing device may further include a sensor 600 for detecting the presence of the panel, an electrical motor for rotating the driving pulley 510 and a controller. The sensor 600 is arranged on the mounting rack 400 and adjacent to the panel 300 to be polished. When the sensor 600 detects the presence of the panel 300, the sensor can generate a sensing signal and send the sensing signal to the controller. The controller can generate a control signal for controlling the rotation of the electrical motor upon the receipt of the sensing signal.

Since there are provided the sensor and the controller, it is possible to achieve an auto-cleaning of the panel, further economizing on labor.

As stated above, the panel polishing device may further include a liquid inlet pipe 700 for introducing liquid, a first switch valve (not shown) mounted on the liquid inlet pipe 700, a gas inlet pipe 800 and a second switch valve 900 mounted on the gas inlet pipe 800.

In the disclosure, when the first switch valve is opened, the liquid may be introduced to the fluid mixture chamber D via the liquid inlet pipe 700; and when the first switch valve is closed, the liquid may not be introduced to the fluid mixture chamber D. In a similar manner, when the second switch valve 900 is opened, the gas may be introduced to the fluid mixture chamber D via the gas inlet pipe 800; and when the second switch valve 900 is closed, the gas may not be introduced to the fluid mixture chamber D.

The first switch valve and the second switch valve may be ordinary manual switch valves or hydraulic valves as long as they can control the open and close of the liquid inlet pipe 700 and the gas inlet pipe 800, respectively.

As a preferable embodiment of the disclosure, both the first switch valve and the second switch valve 900 are solenoid valves. A control terminal of the first switch valve is connected to the controller, and a control terminal of the second switch valve is connected to the controller. Upon the receipt of the sensing signal, the controller may send a first open signal to the control terminal of the first switch valve so as to open the first switch valve. In a similar manner, upon the receipt of the sensing signal, the controller also may send a second open signal to the control terminal of the second switch valve so as to open the second switch valve.

As another aspect of the disclosure, there is also provided a panel cleaning equipment which may include a panel polishing device, a gas source and a liquid source, wherein the panel polishing device is the foresaid panel polishing device according to the disclosure; the gas supplied from the gas source and the liquid supplied from the liquid source are mixed, then enter the through-holes, and are sprayed onto the polishing belt 200 through the through-holes.

As shown in FIG. 12, the panel polishing device may include a liquid inlet pipe 700 that is communicated to the liquid source and a gas inlet pipe 800 that is communicated to the gas source. The gas supplied from the gas source is pressurized gas. Both the liquid inlet pipe 700 and the gas inlet pipe 800 are communicated to the liquid-gas mixture chamber I), so as to guide the liquid and the gas to the liquid-gas mixture chamber D, respectively.

In the panel polishing device according to the disclosure, the pressure of the bi-component fluid can be applied to a relatively large area on the polishing belt 200 and a relatively large area of the polishing belt 200 can be contacted with the panel, such that the panel can be thoroughly cleaned and the cleaning blind region can be eliminated.

In order to facilitate the movement of the panel, the panel cleaning equipment may further include a panel transport unit which is configured to pass the panel 300 through the polishing belt 200 of the panel polishing device and a transport direction of which is perpendicular to the movement direction of the polishing belt.

As shown in FIG. 11, the panel transport unit may include a plurality of conveying rollers 610 for carrying the panel to be polished. When the sensor 600 detects the panel, the sensor 600 can generate a sensing signal and send the sensing signal to the controller. The controller can generate a control signal for controlling the rotation of the electrical motor upon the receipt of the sensing signal. The electrical motor can start to rotate and drive the driving pulley 510 to rotate upon the receipt of the control signal. The polishing belt 200 wound around the driving pulley 510 may start rotating the driven pulley 520 and the tension pulleys 530 and 540, and thus the polishing belt 200 can move circularly. In the meanwhile, the controller may send a signal to the first switch valve and the second switch valve, such that both the first switch valve and the second switch valve are opened. As such, the gas and the liquid may be mixed into the bi-component fluid in the fluid mixture chamber D and sprayed from the through-holes.

In order to facilitate the transportation of the panel, preferably, the panel transport unit may include a front conveying rail and a rear conveying rail, and the panel polishing device may be arranged between the front conveying rail and the rear conveying rail.

In order to clean both surfaces of the panel at the same time to improve the polishing efficiency, preferably, the panel cleaning equipment may comprise two panel polishing devices according to the disclosure, wherein the polishing belts of the two panel polishing devices are disposed oppositely so as to polish both surfaces of the panel at the same time.

In the disclosure, the panel may be a liquid crystal panel or another type of display panel. Alternatively, the panel may be any other panels to be cleaned.

It should be understood that the above embodiments are merely exemplary embodiments for the purpose of illustrating the principle of the invention, and the invention is not limited thereto. Various modifications and improvements can be made by a person having ordinary skill in the art without departing from the spirit and the essence of the invention. Accordingly, all of the modifications and improvements also fall into the protection scope of the invention.

The invention claimed is:

1. A panel polishing device, comprising:

a polishing belt movable along a predefined direction; and a spray head arranged above the polishing belt, the spray head having a main body and a plurality of through-holes which penetrate the main body in a thickness direction of the main body, the plurality of through-holes having outlets facing the polishing belt and being arranged along a length direction of the spray head, and the length direction of the spray head being in conformity with a movement direction of the polishing belt, wherein at least a subset of the plurality of through-holes, located on both sides of the main body, are oblique outwardly with respect to the remaining through-holes.

2. The panel polishing device according to claim 1, wherein the spray head comprises a plurality of rows of through-holes arranged side by side in a width direction of the main body.

3. The panel polishing device according to claim 2, wherein among the through-holes in at least one row arranged in the length direction of the main body, the through-holes in the middle in the length direction of the main body have vertical axes.

4. The panel polishing device according to claim 3, wherein the through-holes of the main body in a row on a downstream side in a movement direction of the panel have outwardly oblique axes.

5. The panel polishing device according to claim 1, wherein with reference to a central line in the length direction of the main body, the axes of the through-holes on a left side are oblique towards the left side of the main body, while the axes of the through-holes on a right side are oblique towards the right side of the main body.

6. The panel polishing device according to claim 1, wherein the panel polishing device further comprises a liquid-gas mixture chamber disposed over the spray head, and the through-holes are communicated with the liquid-gas mixture chamber.

7. The panel polishing device according to claim 1, wherein the panel polishing device comprises a mounting rack and a plurality of driving wheels fixedly attached to the mounting rack;

the polishing belt is wound around the plurality of driving wheels and moves in the predefined direction under the action of the driving wheels; and the spray head is positioned within a region defined by the polishing belt and over a portion of the polishing belt.

8. The panel polishing device according to claim 7, wherein the plurality of driving wheels comprise a driving pulley, a driven pulley and two tension pulleys;

the driving pulley and the driven pulley are position on the same side, and the two tension pulleys are position on the opposite side, such that the polishing belt wound around the plurality of driving wheels is formed into a quadrilateral; and the spray head is fixed to a portion of the polishing belt between the two tension pulleys.

9. The panel polishing device according to claim 7, wherein the panel polishing device further comprises a sensor for detecting the presence of the panel, an electrical motor for rotating the driving pulley and a controller;

the sensor is arranged on the mounting rack and adjacent to the panel;

when the sensor detects the presence of the panel, the sensor is able to generate a sensing signal and send the sensing signal to the controller; and the controller generates a control signal for controlling the rotation of the electrical motor upon the receipt of the sensing signal.

10. The panel polishing device according to claim 9, wherein the panel polishing device further comprises a liquid inlet pipe for introducing liquid, a first switch valve mounted on the liquid inlet pipe, a gas inlet pipe and a second switch valve mounted on the gas inlet pipe.

11. The panel polishing device according to claim 10, wherein both the first switch valve and the second switch valve are solenoid valves;

a control terminal of the first switch valve is connected to the controller, and a control terminal of the second switch valve is connected to the controller;

upon the receipt of the sensing signal, the controller sends a first open signal to the control terminal of the first switch valve so as to open the first switch valve; and upon the receipt of the sensing signal, the controller sends a second open signal to the control terminal of the second switch valve so as to open the second switch valve.

12. A panel cleaning equipment, comprising a panel polishing device, a gas source and a liquid source, wherein the panel polishing device is the panel polishing device comprising:

a polishing belt movable along a predefined direction; and a spray head arranged above the polishing belt, the spray head having a main body and a plurality of through-holes which penetrate the main body in a thickness direction of the main body, the plurality of through-holes having outlets facing the polishing belt and being arranged along a length direction of the spray head, and the length direction of the spray head being in conformity with a movement direction of the polishing belt, wherein at least a subset of the plurality of through-holes, located on both sides of the main body, are oblique outwardly with respect to the remaining through-holes; and the gas supplied from the gas source and the liquid supplied from the liquid source are mixed, then enter the plurality of through-holes, and are sprayed onto the polishing belt through the plurality of through-holes.

13. The panel cleaning equipment according to claim 12, wherein the panel cleaning equipment comprises a panel transport unit which is configured to pass the panel through the polishing belt of the panel polishing device and a transport direction of which is perpendicular to the movement direction of the polishing belt.

14. The panel cleaning equipment according to claim 13, wherein the panel transport unit comprises a front conveying rail and a rear conveying rail, and the panel polishing device is arranged between the front conveying rail and the rear conveying rail.

15. The panel cleaning equipment according to claim 12, wherein the panel cleaning equipment comprises two panel polishing devices; and the polishing belts of the two panel polishing devices are disposed oppositely so as to polish both surfaces of the panel at the same time.

16. The panel cleaning equipment according to claim 12, wherein the spray head comprises a plurality of rows of through-holes arranged side by side in a width direction of the main body.

17. The panel cleaning equipment according to claim 12, wherein the panel polishing device further comprises a liquid-gas mixture chamber disposed over the spray head, and the through-holes are communicated with the liquid-gas mixture chamber.

18. The panel cleaning equipment according to claim 12, wherein the panel polishing device comprises a mounting rack and a plurality of driving wheels fixedly attached to the mounting rack;

the polishing belt is wound around the plurality of driving wheels and moves in the predefined direction under the action of the driving wheels; and the spray head is positioned within a region defined by the polishing belt and over a portion of the polishing belt.

19. The panel cleaning equipment according to claim 18, wherein the plurality of driving wheels comprise a driving pulley, a driven pulley and two tension pulleys;

the driving pulley and the driven pulley are position on the same side, and the two tension pulleys are position on the opposite side, such that the polishing belt wound around the plurality of driving wheels is formed into a quadrilateral; and the spray head is fixed to a portion of the polishing belt between the two tension pulleys.

20. The panel cleaning equipment according to claim 18, wherein the panel polishing device further comprises a sensor for detecting the presence of the panel, an electrical motor for rotating the driving pulley and a controller;

the sensor is arranged on the mounting rack and adjacent to the panel;

when the sensor detects the presence of the panel, the sensor is able to generate a sensing signal and send the sensing signal to the controller; and the controller generates a control signal for controlling the rotation of the electrical motor upon the receipt of the sensing signal.

* * * * *